US005133656A

United States Patent [19]

Peterson

[11] Patent Number: 5,133,656

[45] Date of Patent: Jul. 28, 1992

[54] FUEL BURNER VALVE OPERATOR CIRCUIT WITH INTERMITTENT IGNITION

[75] Inventor: Scott M. Peterson, Eden Prairie, Minn.

[73] Assignee: Honeywell Inc., Minneapolis, Minn.

[21] Appl. No.: 656,313

[22] Filed: Feb. 19, 1991

[51] Int. Cl.[5] ..... F23N 5/00

[52] U.S. Cl. ..... 431/66; 431/78

[58] Field of Search ..... 431/74, 66, 78-80, 431/258

[56] References Cited

U.S. PATENT DOCUMENTS 3,676,042 6/1970 Oborne ..... 431/66
4,190,414 2/1980 Elmy ..... 432/46
4,269,589 5/1981 Matthews ..... 431/46
4,306,853 12/1981 Rippelmeyer ..... 431/66
4,323,342 2/1982 Sommers, Jr. et al. ..... 431/66
4,360,338 11/1982 Katchka ..... 431/43
4,806,095 2/1989 Goldstein et al. ..... 431/54

*Primary Examiner*—Carroll B. Dority
*Attorney, Agent, or Firm*—Edward Schwarz

[57] ABSTRACT

A burner control system conditions opening of the fuel control valve on proper operation of a hot surface igniter for igniting the fuel. Current flow through and voltage across the hot surface igniter is constantly monitored, and if either is not proper, the valve closes. A pair of diodes provides half wave DC current of different polarity respectively for the hot surface igniter and the valve actuator.

8 Claims, 2 Drawing Sheets

FUEL BURNER VALVE OPERATOR CIRCUIT WITH INTERMITTENT IGNITION

BACKGROUND OF THE INVENTION

Because of the waste of fuel resulting from the use of burners whose main burner ignition is accomplished by a standing pilot burner, the fuel burner control industry is shifting to electrical igniters of various types to ignite the fuel each time heat is demanded. The great advantage of the standing pilot technology is that of very high reliability and safety. The presence of a standing pilot flame can be easily and cheaply sensed by the heat it generates, and the pilot flame heat sensor can then override opening of the main valve if the pilot flame is not sensed. It goes without saying that it is important that the main valve not be opened if there is no means to ignite the fuel once it starts flowing.

Of the various types of electrical igniters, one which has reliability and long life is the hot surface igniter, and for these reasons has become very popular. A hot surface igniter typically comprises a small element formed of silicon carbide or other conductive refractory material. Current is passed through this element until its temperature reaches upwards of 1000° F., which is sufficient to ignite a combustible mixture of air and some fuel such as natural gas or propane fuel.

It is not so simple to directly detect proper operation or functionality of a hot surface igniter as it is for a pilot flame, because the total amount of heat which such devices emit is substantially smaller than that released by a pilot flame. Direct detection of hot surface igniter operation is exemplified by U.S. Pat. Nos. 4,323,342 (Sommers et al.) and 3,676,042 (Osborne). It is also possible to sense the presence of the flame which the ignition operation is intended to produce, and if flame is not present within a short time after opening the valve, then close the valve. One can find this design in U.S. Pat. Nos. 4,190,414 (Elmy); 4,360,338 (Katchka); 4,269,589 (Matthews); and 4,806,095 (Goldstein et al.) The disadvantage of this latter approach is that malfunction is sensed only after fuel has flowed for a time without ignition. Furthermore, if more than a small amount of fuel has flowed without being ignited, it is not safe to retry ignition until the burner enclosure has been purged, particularly if the main burner is being directly ignited. Such purging requires a blower, which smaller burner systems typically do not have. Therefore it is necessary to disable the burner control until serviced, which is inconvenient, particularly if the fault was only an intermittent one.

Another factor which must be considered involves the operation of the thermostat, the closing of whose contacts typically generates the demand signal calling for heat. Loads applied to these thermostats should in general be within the range of current required to operate a valve actuator. If the load is much larger, life of the thermostat contacts is shortened. If the load is much smaller, then the heat anticipation required for proper thermostat response is adversely affected.

Accordingly, efficiency, safety, and convenience of such burner systems employing igniters to establish the flame can be improved if another way of establishing proper operation of the igniter before opening the fuel valve can be found.

My copending application entitled "Fuel Burner Having an Intermittent Pilot With Pre-Ignition Testing" and having the same assignee as this application tests the operation of an igniter such as a hot surface igniter by sensing the current which the igniter draws and the voltage across it. If both are within preselected limits established for the igniter, proper igniter operation can be assumed.

BRIEF DESCRIPTION OF THE INVENTION

This invention, a variation on my just-mentioned copending application, uses a portion of the igniter current to open a valve having a DC powered actuator. If the igniter has burned out and is not passing current, there will be no current supplied to the valve actuator. Without valve actuator current the valve will not open and therefore fuel will not flow. But if the igniter is passing current and therefore presumably able to light the fuel then the valve actuator will receive current and open.

Ignition apparatus embodying this invention has in its simplest embodiment, first and second power terminals which receive power when heat is required, as by closing of thermostat contacts. The ignition apparatus includes a valve allowing flow of fuel to the burner responsive to application of DC electric power to the actuator of the valve. This actuator has first and second terminals. The ignition apparatus includes an electrically powered igniter juxtaposed to the burner. Application of AC power to the ignition apparatus power terminals begins the sequence of operations culminating in igniting of the burner in the burner system of which the ignition apparatus is a part.

The apparatus includes diode having a first terminal connected to the first terminal of the valve actuator and to the ignition apparatus' first power terminal, and a second terminal connected to the second terminal of the valve actuator. Electrical connectors connect the igniter between the second terminal of the diode and the second power terminal. One can see that when power is applied to the ignition apparatus' first and second power terminals, as when thermostat contacts close, current flows through both the igniter and, when the diode is back biased by the negative half of the power cycle, through the valve actuator as well. All of the valve actuator current flows through the igniter.

While the above circuit is perfectly suitable from a safety standpoint, it has a number of operational disadvantages which make it undesirable for commercial use. Among these are the relatively high igniter current which the thermostat contacts must switch, and the impact which this large current has on the heat generation of the anticipator resistor. While it is possible to design thermostats with contacts and anticipation resistors to handle this level of current, it is preferable for such ignition controls to be compatible with existing thermostats.

Modifications to this simplified ignition control are possible which result in a design retaining the same safety advantage of the above-described circuit and which is compatible with existing thermostats. Such a modified ignition apparatus includes a demand responsive switch such as a thermostat controlling flow of power from said ignition apparatus' first terminal to a third terminal of the ignition apparatus. This ignition apparatus further includes a relay having a pair of normally open contacts and a winding closing the contacts responsive to power applied to the relay winding terminals. The relay contacts are in series connection with the igniter to form a series circuit having first and second terminals, the second terminal of which is connected to the ignition apparatus' second terminal. A connector electrically connects the series circuit's first terminal and the valve actuator's second terminal. First, second, and third diodes each have a first terminal connected to the same one of each of the diodes' anode and cathode elements and a second terminal connected to the other of the diodes' anode and cathode elements. The second diode has its first and second terminals respectively connected to the valve actuator's first terminal and to the igniter apparatus' third power terminal. The first diode has its first and second terminals respectively connected to the igniter apparatus' first power terminal and the connector. The third diode has its first and second terminals respectively connected to the valve actuator's first and second terminals.

A relay driver is connected between the first diode's second terminal and the ignition apparatus' second terminal to receive power. This relay driver has relay terminals connected to the relay winding and has a control terminal receiving an operation signal thereat. The relay driver provides electric power from the ignition apparatus first and second terminals to the relay winding to close the relay contacts responsive to the operation signal. There are further, operation means in electrical communication with the ignition apparatus third terminal for supplying an operation signal to the relay driver while power is applied to the third terminal.

In operation, this ignition apparatus prevents flow of electrical current through the valve's actuator whenever the igniter is shorted or open, but allows flow of current to the valve's actuator if neither of these conditions exist. One can see that opening of the valve can occur only if the igniter is capable of igniting the fuel which will then flow through the valve. At the same time, igniter current does not flow from the third terminal of the ignition apparatus, and therefore the demand responsive switch does not pass the igniter current.

Accordingly, one purpose of this invention is to prevent opening of a fuel valve until its igniter has current flow considered adequate to ignite the fuel.

A second purpose of the invention is to use the conductive characteristics of the igniter to control the opening of the fuel valve.

A further purpose of this invention is to prevent opening of the fuel valve if any of the safety critical components of the ignition apparatus fail either by opening or by shorting, or by losing the ability to change state.

Yet another purpose of this invention is to provide a control interface compatible with existing thermostats which may be used as the demand responsive switch.

Other purposes and advantages of the invention will become apparent from the specific details of the invention following.

DESCRIPTION OF THE PREFERRED EMBODIMENTS

There are a number of different circuits which can be considered to embody the invention, but the main concept and the desirable variations can be shown by two different circuits.

Figure 1:
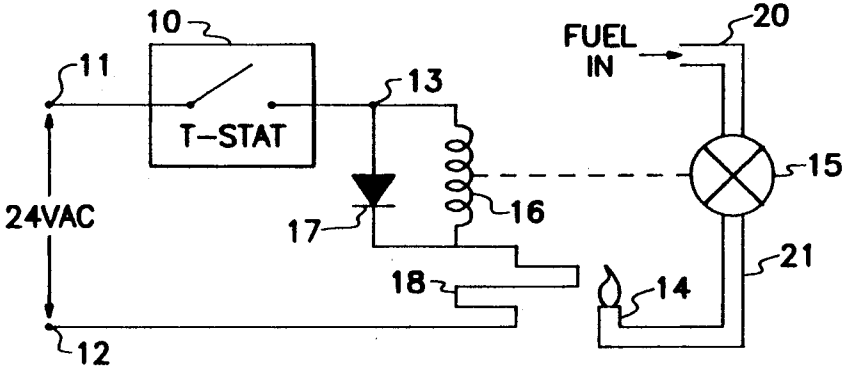
FIG. 1 is a simplified circuit of ignition apparatus where the valve actuator current flows through the igniter.

The simplified circuit of FIG. 1 can in fact be used with a thermostat or other demand sensing means which can control relatively large current flow. It is included to illustrate the most important feature of the invention here which is the safety provided by allowing only current which flows through the igniter (preferably of the hot surface type) in an electrically ignited fuel burner, to flow through the fuel valve actuator so as to prevent opening of the fuel valve whenever the igniter does not have electrical continuity. This is accomplished by using half cycles of one polarity in an AC control voltage to power the igniter only, and half cycles of the other polarity to provide the power for opening the fuel valve as well as to provide igniter power. This circuit, as well as those of FIGS. 2 and 3, can be used with either a direct ignition burner system where there is a main burner only, or a pilot burner type of system. In the case of the circuits of FIGS. 1 and 2, there is no need for a flame sensor since the igniter is always passing current for ignition. However, since the circuit of FIG. 3 removes current from the igniter when ignition has occurred, a flame sensor is required.

In this circuit, 24 VAC power is applied to terminals 11 and 12 at all times. Whenever it is necessary to ignite a burner 14, as sensed by a thermostat 10 or other control element, terminal 13 is connected to terminal 11. In the burner system, flow of fuel such as natural gas or propane to burner 14 is controlled by a valve 15 which receives fuel from a fuel source through a pipe. The valve 15 position as open or closed is controlled by a DC actuator 16, this control being symbolized by the dotted line connecting them. The electrical element in actuator 16 is a winding driven by a DC voltage applied across its two terminals, with valve 15 opening when current flows in actuator 16. Currently available valve actuators are of the type for which half wave DC from a 24 VAC source is sufficient to open valve 15. A diode 17 is connected in parallel with actuator 16, and supplies half wave power to an igniter 18 in series with the parallel circuit formed by actuator 16 and diode 17.

Igniter 18 is of the type which when receiving half wave DC power derived from 24 VAC is heated to a temperature sufficient to invariably ignite a fuel-air mixture flowing from burner 14. In this circuit, igniter 18 receives DC power from diode 17 during the positive half of each AC cycle. While diode 17 is forward biased by positive half cycles, actuator 16 is in effect shorted so that no current flows in it. During the negative half of each AC cycle, diode 17 is back biased and no current flows through it. However, during negative half cycles current does flow through actuator 16, and therefore actuator 16 receives half wave DC. All current flowing through actuator 16 also flows through igniter 18. Since the impedance of igniter 18 is much smaller than that of actuator 16, the half wave current flow through igniter 18 during the negative half cycles is sufficient to power actuator 16 to open valve 15.

It can thus be seen that when thermostat 10 closes, current flow through diode 17 quickly raises igniter 18 to a temperature which will ignite a fuel-air mixture flowing from burner 14. The current flowing through igniter 18 when diode 17 is back biased will cause actuator 16 to open valve 15 to provide the fuel for this fuel-air mixture. The assumption that an igniter 18 which is drawing current is capable of lighting a fuel-air mixture, is a very safe assumption to make. Since there is concern about the longevity of igniter 18 however, by drawing the valve actuation current from the igniter current, one can be certain that the valve 15 will not open unless the igniter 18 is drawing current. Since these igniters invariably fail by opening rather than by shorting, there is a high level of confidence that igniter malfunction will not result in the potentially unsafe situation of an open valve 15 without the igniter 18 receiving power.

Diode 17 also functions as the flyback diode for actuator 16 so that during the positive half cycles when actuator 16 is shorted by diode 17 and receives no power, its inductive current output passes through diode 17. Accordingly, with this design, there is no need for a separate flyback diode to pass the inductive current generated at the end of each negative half cycle.

The major safety requirement for this ignition control circuit, that valve 15 never open unless ignition is certain to occur, i.e., igniter 18 is operational, is thus met.

There are, however, the aforementioned disadvantages of this circuit which dictate that commercial devices should have additional features. Because thermostats are usually designed with heat anticipators which operate properly on actuator current rather than the larger igniter currents, it is inconvenient to require thermostat redesign to accommodate the current requirements of this FIG. 1 ignition apparatus.

Figure 2:
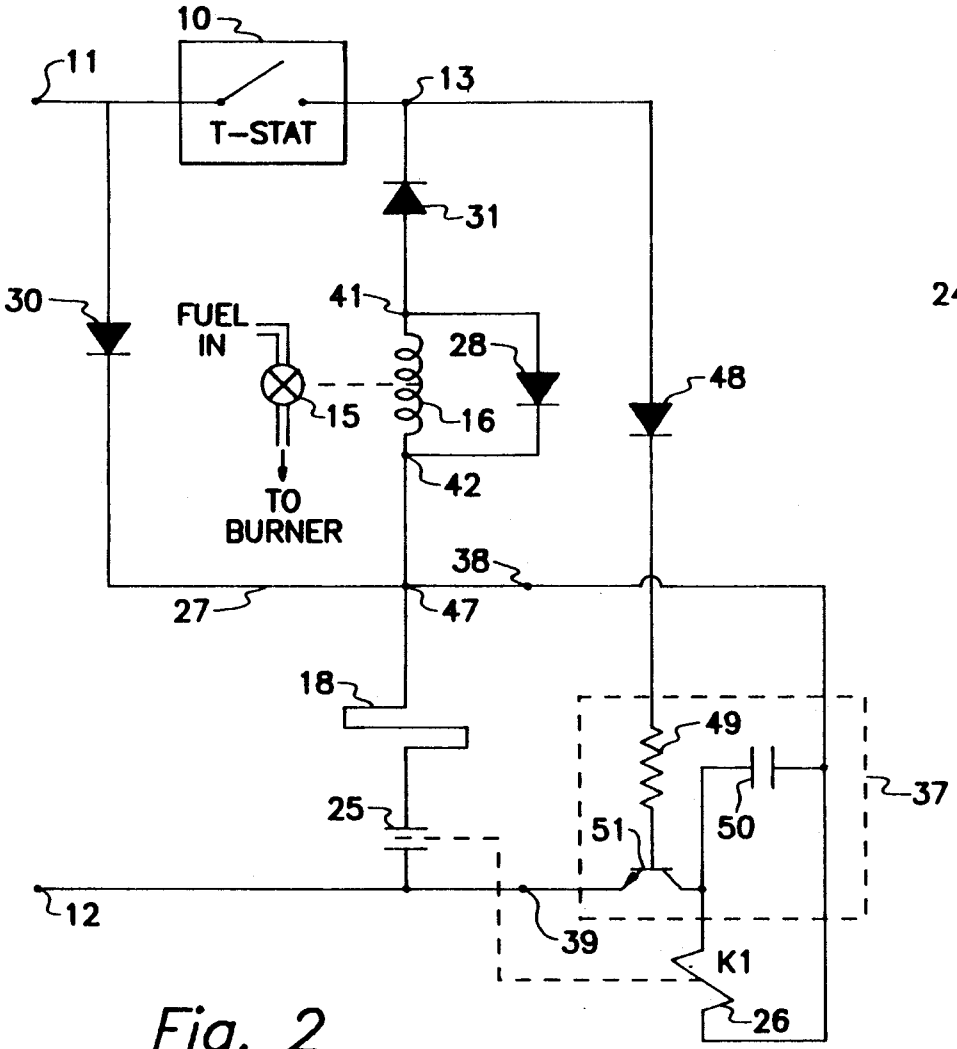
FIG. 2 is an improvement of the circuit of FIG. 1 with the igniter current routed around the thermostat or other control contacts.

FIG. 2 shows a circuit for igniting a burner and in which relay contacts carry the relatively heavy igniter current. In FIGS. 1 and 2 (as well as in FIG. 3), similar reference numbers denote elements having similar functions. No further discussion of these similar elements in FIG. 2 is deemed necessary.

The igniter current in FIG. 2 is switched by a K1 relay comprising a winding 26 and a normally open contact pair 25 wherein the dotted line connection between them indicates control of the contacts by the winding. The thermostat 10 provides power for the valve actuator 16 at the third power terminal 13 as well as for an operation signal for a relay driver 37. Power for igniter 18 is almost totally supplied by a first diode 30 through a connector 27, which also supplies the current for the relay winding 26 through the relay driver 37. Winding 26 is connected to relay terminals of driver 37. The relay driver 37 is shown as comprising a resistor 49, a transistor 51, and a capacitor 50 which filters the half wave DC current flow applied to winding 26. A diode 48 supplies D control current to the base of transistor 51 from power terminal 13, so in effect the thermostat 10 controls flow of current to igniter 18 through the relay driver 37 and its associated relay. It should be understood that the relay driver 37 may have a design different from that shown.

When thermostat 10 closes, the voltage at terminal 13 cause transistor 51 in driver 37 to conduct current provided by diode 30 through the relay driver terminals to winding 26 of the relay. Relay contacts 25 close and half wave DC current from diode 30 also flows through igniter 18 causing igniter 18 to heat. A second diode 31 connected between winding 16 and terminal 13 limits current flowing through actuator 16 to that of the half cycles opposite those flowing through diode 30. The actuator 16 current causing valve 15 to open flows through contacts 25 and igniter 18. With the igniter 18 heated and the valve actuator 16 receiving power, ignition quickly and surely occurs. It can be seen that if igniter 18 fails by opening, no actuator 16 current flows, and consequently, fuel cannot flow to the burner. Therefore, no dangerous condition of unburning fuel flowing through valve 15 can occur. Further analysis will show that no failure of an electrical component in this ignition control circuit can cause this unsafe condition of unburned fuel flow can occur.

Figure 3:
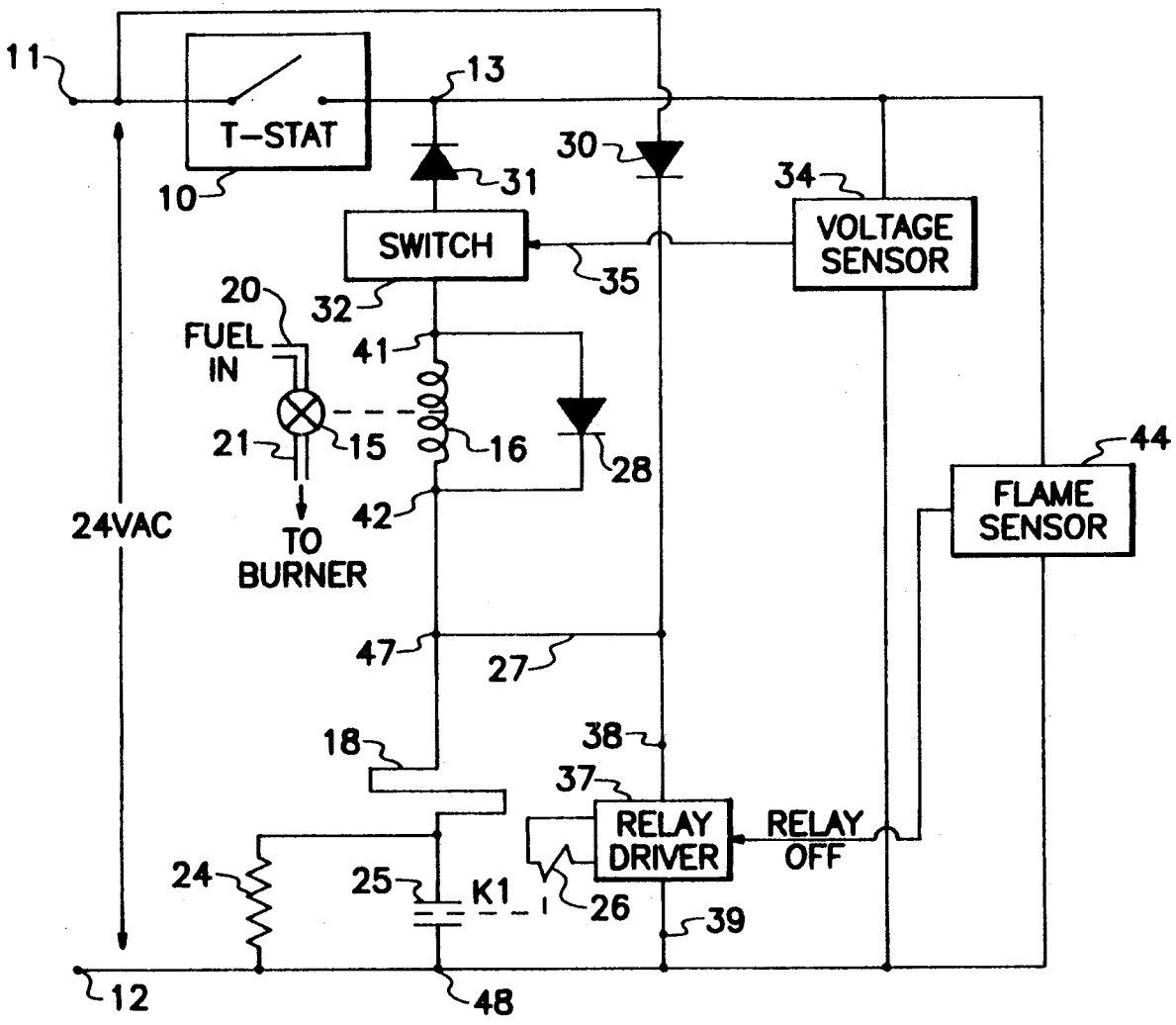
FIG. 3 is an improvement of the circuit of FIG. 2, with current applied to the igniter only during ignition sequences, and includes additional safety features.

The circuit shown in FIG. 3 provides the further benefit of removing power from the igniter 18 when combustion of the fuel is occurring, thereby extending the life of the igniter. One should note that the circuit of FIG. 3 shows a flame sensor which is required for safety and which causes the igniter to receive its ignition current and otherwise operate properly when flame is not present.

In FIG. 3 as in FIGS. 1 and 2, power, typically 24 VAC, is constantly provided between terminals 11 and 12 when the ignition apparatus is in normal use. When heat is demanded, thermostat 10 closes, applying the AC power to terminal 13 as a demand signal. A first diode 30 has its anode connected to power terminal 11 and has its cathode connected to a first terminal 38 of the relay driver 37 to constantly supply half wave DC power to the relay driver 37. A second terminal 39 of relay driver 37 is connected to power terminal 12 to complete this circuit. Relay driver 37 in FIG. 3 may have the design shown for the relay driver 37 in FIG. 2, or may have a different design. Relay driver 37 also has a pair of relay terminals connected to the winding 26 of a K1 relay by which power is applied to actuate the relay. Relay driver 37 also has a control terminal at which an operation signal may be applied by a flame sensor 44. When the operation signal is present, relay driver 37 energizes winding 26 causing the K1 relay contacts 25 to close. Relay driver 37 has a relatively high impedance between its power terminals 38 and 39.

There is a series circuit comprising the K1 relay contacts 25 and the igniter 18. This series circuit is shown as having terminals 47 and 48, with terminal 47 connected via connector 27 to relay driver terminal 38, and terminal 48 connected to power terminal 12. There is a shunt resistor 24 in parallel connection with relay contacts 25. The value of shunt resistor 24 must be such that it allows current flow to valve actuator 16 sufficient to hold valve 15 open, but insufficient to open valve 15 if closed. Valve actuator 16 has terminals 41 and 42 and is in series connection with second diode 31 and in parallel connection with a third diode 28 to form an actuator circuit. The anode of diode 31 is connected to an actuator terminal 41 through switch 32, and the cathode of diode 31 is connected to power terminal 13. An actuator terminal 42 is connected to connector 27. Diode 28 is connected with its anode connected to terminal 41 and its cathode connected to terminal 42, the anodes of diodes 28 and 31 thus being connected together at terminal 41. It should be noted that the orientation of the diodes with respect to each other is essential, but that if the diode orientations are all reversed the circuit will still operate properly. It is possible that if the diode orientations are reversed, the driver 37 will have to be modified or its orientation also reversed for proper circuit operation.

There is also a switch circuit 32 in the actuator circuit which receives a closure signal on conductor 35 from a voltage sensor 34. Voltage sensor 34 is connected between power terminals 12 and 13 and supplies the closure signal to switch circuit 32 when the normal voltage provided at terminal 12 is present at terminal 13. Voltage sensor 34 and its related switch 32 are provided to deal with a situation where a brownout or other condition reducing voltage across terminals 11 and 12 occurs. It is possible that in such a case there will be enough current to operate valve 15 but insufficient current to heat igniter 18 enough to ignite the fuel flowing through valve 15. Since this is a potentially hazardous situation, the voltage sensor 34 is set to open switch if such a drop in input voltage occurs.

The flame sensor 44 which provides the operation signal to relay driver 37 is also connected across terminals 12 and 13. When flame sensor 44 does not sense a flame present in the burner and further, receives power at terminal 13, the operation signal is provided to driver 37. When a flame is present in the burner or flame sensor 44 does not receive power, the operation signal is not provided. The flame sensor 44 by thus causing power to be removed from the igniter 18 when flame is present reduces electric power requirements of the control system and increases the life of igniter 18. It can be seen that when flame is finally detected as present by flame sensor 44 during a startup sequence, only then are relay contacts 25 opened. Power to keep valve 15 open after relay contacts 25 have opened is then supplied by resistor 24 which is placed in parallel with contacts 25, so power flows through the relatively low impedance igniter 18 and through shunt resistor 24 to actuator 26, and in this way power to actuator 16 is maintained even if power is not supplied to igniter 18. When the demand is satisfied and thermostat 10 opens, power is removed from terminal 13 and valve 15 closes. Relay contacts 25 then close because flame sensor 44 no longer receives power from terminal 13 and can no longer provide the operation signal. Thus when the thermostat 10 later closes again in response to renewed demand, power flows to igniter 18 and valve actuator 16.

It can be seen that should power be completely removed from terminals 11 and 12 due to a power outage or a blown fuse or circuit breaker, valve 15 will of course close. When power is restored, the thermostat 10 will still be demanding heat, so power will be present at terminal 13. Since there will be no flame to be detected by flame sensor 44, the operation signal is supplied to driver 37 and power will flow to igniter 18 and actuator 16 in the normal fashion.

When considering the safety aspects of this circuit, an important advantage of it is that no single component failure can result in the potentially dangerous condition of a powered actuator 16 with the igniter 18 unpowered. If diode 30 should burn out and open, relay driver 37 will not receive power and hence contacts 25 will not close, and neither igniter 18 nor actuator 16 will receive power. If diode 30 should short, then relay driver receives AC rather than DC power, and will not operate to actuate the K1 relay to close contacts 25. If relay driver 37 or the K1 relay malfunctions by failing to close contacts 25 when thermostat 10 contacts close, then power can flow to neither igniter 18 nor actuator 16. To provide this safety, the design of driver 37 must be such that any current which it draws is too small to allow actuator 16 to open valve 15, and this is the preferred design. If relay driver 37 fails by shorting out, then a direct short through diode 30 across terminals 11 and 12 exists, a circuit breaker not shown will shut down the power flow to terminals 11 and 12.

A common mode of failure is for igniter 18 to open. In this case, power cannot flow to actuator 16, so valve 15 will not open. If igniter 18 shorts, then no voltage across driver 37 can exist, and the circuit will therefore oscillate, causing possible harm to the K1 relay and driver 37, but cannot result in valve 15 opening. If diode 31 shorts, thermostat 10 then carries igniter current but no unsafe condition arises. If diode 31 opens, then actuator 16 does not receive power. If diode 28 shorts, then actuator 16 can receive no power because there is no voltage across it. If diode 28 opens then back emf during the positive half cycles can damage any of the diodes 30 or 31 by exceeding their reverse voltage rating. This however, while inconvenient, will riot create an unsafe condition.

One can thus see that the circuit of FIG. 3 is able to safely and reliably cause a fuel valve to be opened in response to a demand signal and then promptly power an igniter to ignite the fuel that flows from that valve. At the same time, almost every conceivable type of single component failure will not result in unsafe operation.

The reader should note that many of the design features shown here are arbitrary, and other designs are available which will accomplish the identical function.

What I wish to claim by Letters Patent is:

1. Ignition apparatus having first and second terminals for, responsive to application of AC power to its terminals, igniting the burner in a burner system of which the ignition apparatus is a part, said burner system including a valve allowing flow of fuel to the burner responsive to application of DC electric power to an actuator of the valve, said actuator having first and second terminals, said ignition apparatus including an electrically powered igniter juxtaposed to the burner for igniting fuel flowing therefrom, and said ignition apparatus including a demand responsive switch controlling flow of power from said ignition apparatus' first terminal to a third terminal of the ignition apparatus, said ignition apparatus further comprising the improvement of a) a relay having a pair of normally open contacts and a winding closing the contacts responsive to power applied to the relay winding terminals, said relay contacts in series connection with the igniter to form a series circuit having first and second terminals, said series circuit's second terminal connected to the ignition apparatus' second terminal;

b) a connector between the series circuit's first terminal and the valve actuator's second terminal;

c) first, second, and third diodes, each having a first terminal connected to the same one of the diodes' anode and cathode elements and a second terminal connected to the other of the diodes' anode and cathode elements, said second diode having its first and second terminals respectively connected to the valve actuator's first terminal and to the igniter apparatus' third, power terminal, said first diode having its first and second terminals respectively connected to the igniter appartus' first power terminal and the connector, and said diode having its first and second terminals respectively connected to the valve actuator's first and second terminals;

d) a relay driver connected between the first diode's second terminal and the ignition apparatus' second terminal to receive power, said relay driver having relay terminals connected to provide power to the relay winding and having a control terminal receiving an operation signal thereat, said relay driver providing electric power from the ignition apparatus first and second terminals to the relay winding to close the relay contacts responsive to the operation signal; and e) operation means in electrical communication with the ignition apparatus third terminal for supplying an operation signal to the relay driver while power is applied to the third terminal;

wherein said ignition apparatus, whenever the igniter is shorted or open, prevents flow of electrical power from the ignition apparatus' first and second terminals through the valve's actuator to thereby prevent opening of the valve in that situation.

2. The ignition apparatus of claim 1, wherein the operation means comprises a fourth diode.

3. The ignition apparatus of claim 1, including an electrically controllable switch having power terminals in series the second diode and forming therewith a series connected between the ignition apparatus terminal and the valve actuator's first said switch electrically connecting its power terminals responsive to a closure signal and electrically disconnecting the power terminals absent a closure signal, wherein the operation means comprises a voltage sensor connected between the ignition apparatus' third and second terminals, said voltage sensor including means for supplying the closure signal to the switch responsive to the voltage between the ignition apparatus' second and third terminals having at least a predetermined value.

4. The ignition apparatus of claim 3, wherein the valve is of the type whose actuator requires a first current level to open the valve, and a second current level smaller than the first current level to hold open the valve, and the relay driver is of the type further comprising a resistor in parallel connection with the relay contacts, said resistor of value allowing current flow to the valve actuator of between the first second current levels.

5. The ignition apparatus of claim 4 wherein the operation means comprises a flame sensor in combustion sensing juxtaposition to the burner, and providing the operation signal to the relay driver responsive to absence of combustion of fuel provided by the burner.

6. The ignition apparatus of claim 1, further comprising a resistor in parallel connection with the relay contacts, said resistor of value allowing current flow to the valve actuator sufficient to hold the valve open when the relay contacts are open and insufficient to open the valve if the valve is closed; and wherein the operation means comprise a flame sensor in flame sensing juxtaposition to the burner, and providing an operation signal to the relay driver responsive to absence of combustion of fuel provided by the burner.

7. Ignition apparatus having first and second power terminals for, responsive to direct application of full wave AC power to the power terminals, igniting the burner in a burner system of which the ignition apparatus is a part, said burner system including a valve allowing flow of fuel to the burner responsive to application of DC power to an actuator of the valve, said actuator having first and second terminals, and said ignition apparatus including an electrically powered igniter juxtaposed to the burner, said ignition apparatus further comprising the improvement of a) a diode having a first terminal directly connected to the first terminal of the valve actuator and a second terminal connected to the second terminal of the valve actuator;

b) electrical connectors directly connecting the igniter between the second terminal of the diode and the second power terminal; and c) an electrical connector directly connecting the first terminal of the diode to the first power terminal, thereby allowing half wave power of one phase to flow through the valve actuator and half wave power of the opposite phase to flow through the diode, and both half waves to flow through the igniter.

8. The ignition apparatus of claim 7, wherein the igniter is a hot surface igniter.

* * * * *

UNITED STATES PATENT AND TRADEMARK OFFICE

CERTIFICATE OF CORRECTION

PATENT NO. : 5,133,656

DATED : Jul.28, 1992

INVENTOR(S) : Scott M. Peterson

It is certified that error appears in the above-identified patent and that said Letters Patent is hereby corrected as shown below:

Column 8, line 58, cancel ",".

Column 9, line 20, add "circuit" after series.

Column 9, line 20, add "third" after apparatus.

Column 9, line 21, add "terminal" after first.

Signed and Sealed this

Thirtieth Day of November, 1993

Bruce Lehman

*Attest:*

BRUCE LEHMAN

*Attesting Officer*

*Commissioner of Patents and Trademarks*